US006438796B1

(12) United States Patent
Davidson

(10) Patent No.: US 6,438,796 B1
(45) Date of Patent: Aug. 27, 2002

(54) INTEGRALLY MOLDED STUD FITTING FOR DRAPERY TRACK

(76) Inventor: Henry A. Davidson, 9222 Easthaven Blvd., Houston, TX (US) 77075

( * ) Notice: Subject to any disclaimer, the term of this patent is extended or adjusted under 35 U.S.C. 154(b) by 0 days.

(21) Appl. No.: 09/832,144

(22) Filed: Apr. 10, 2001

(51) Int. Cl.[7] ..... E05D 15/00; A47H 15/00

(52) U.S. Cl. ..... 16/93 R; 16/87.2; 160/330

(58) Field of Search ..... 16/93 R, 87.2, 16/87.4 R, 87.6 R, 87.8, 93 D, 94 D, 95 D, 96 D; 160/330, 345–348, 123, 124, 126

(56) References Cited

U.S. PATENT DOCUMENTS

| | | | | | |
|---|---|---|---|---|---|
| 3,248,749 | A | * | 5/1966 | Williams | 16/87.2 |
| 3,626,429 | A | * | 12/1971 | Toder | 16/87.2 |
| 3,730,249 | A | | 5/1973 | Hess | |
| 3,808,633 | A | * | 5/1974 | Lauterbach | 16/87 R |
| 4,153,097 | A | | 5/1979 | Pettibone | |
| 4,827,565 | A | * | 5/1989 | Froutzis | 16/87.4 R |
| 4,972,895 | A | | 11/1990 | Meshaka | |
| 5,331,993 | A | | 7/1994 | Billbury | |
| 5,522,635 | A | | 6/1996 | Downey | |
| 5,560,084 | A | | 10/1996 | Baker | |
| 5,609,197 | A | * | 3/1997 | Liao | 160/330 |
| 5,873,642 | A | * | 2/1999 | Domenig | 16/93 R |
| 5,974,738 | A | * | 11/1999 | Jacobs | 16/95 R |
| 6,076,881 | A | | 6/2000 | Tucker | |
| 6,223,389 | B1 | * | 5/2001 | Walsh et al. | 16/87.2 |
| 6,334,477 | B1 | * | 1/2002 | Moir | 160/168.1 V |

* cited by examiner

*Primary Examiner*—Chuck Y. Mah
(74) *Attorney, Agent, or Firm*—Gordon K. Anderson

(57) ABSTRACT

A drapery track fitting for use with a channel-shaped track (28) or tee-shaped track (30) holds drapery secure in a vibration and shock environment. The fitting may be an end cap (20), a carrier (22), or the like, and interfaces with the track either on the end or slideably mounted therewith. The fitting in either embodiment includes an integral stud (34), fabricated by injection molding, replacing a snap fastener metallic stud (38) used by prior art. The drapery employs a snap fastener socket (36) attached to the fabric which snaps over the integral socket on the fitting to hold the drapes securely in place, and yet, provides a removable feature for cleaning or replacement.

13 Claims, 4 Drawing Sheets

INTEGRALLY MOLDED STUD FITTING FOR DRAPERY TRACK

TECHNICAL FIELD

The present invention relates to stud fasteners in general, and more particularly to a male stud fastener that is integrally formed onto a drapery track fitting such as a carrier or end cap for mating with a female socket.

BACKGROUND ART

Previously, metallic snap fasteners have been used for attaching drapery to track, particularly in the marine industry and industrial truck cabs where strength and convenience is essential. In the past, the type of drapery material used is stout and robust, as it has greater utility than for style and appearance only and is designed for constant use in these nautical or over-the-road applications. Prior art, in other window covering applications, use varied approaches for attachment and pleating, such as hooks, loops, etc. Channel and tee-shaped drapery tracks are also well known in the industry, along with slides and carriers that are contained within or on top of the track. It is not uncommon to develop a specific approach for mounting not only drapes, but skirts and other fabric materials. Snap fasteners made by Dot, Scoval, and a host of others, dominate the market and are readily available, however, some attempt has been made in the past to copy the basic usefulness with fasteners that utilize the resilient qualities of thermoplastic instead of spring metal. It has been found however that these other devices are not as strong or positive as the so-called snap fastener that uses a spring ring within a metallic disk shaped to accomplish the gripping effect. It should be noted that this type of fastener has had a long and successful history, as they have been used extensively in the clothing industry for closures in jackets, shirts, etc., they have also been in constant use for fastening leather and sporting goods for decades.

A search of the prior art did not disclose any patents that read directly on the claims of the instant invention, however, the following U.S. patents are considered related:

| Patent No. | Inventor | Issue Date |
|---|---|---|
| 6,076,881 | Tucker | June 20, 2000 |
| 5,560,084 | Baker | Oct. 1, 1996 |
| 5,522,635 | Downey | June 4, 1996 |
| 5,331,993 | Billbury | July 26, 1994 |
| 4,972,895 | Meshaka | Nov. 27, 1990 |
| 4,153,097 | Pettibone | May 8, 1979 |
| 3,730,249 | Hess | May 1, 1973 |

U.S. Pat. No. 6,076,881 of Tucker is for a support frame for a rail based tonneau cover for a pick-up truck. The support frame has a pivotable portion permitting access to the bed without removing the cover form the rails. A latching mechanism is accessible only upon lowering the tailgate of the truck with the latching mechanism and support are interconnected.

U.S. Pat. No. 5,560,084, issued to Baker, discloses a friction slider for attachment to struts of a stay. The body is formed of metal and is shaped to be retained within the channel of the stay. A plastic skin overlays the metal to separate it from the stay during use. Adjustment means accommodate the necessary friction between the slider, channel and stay.

Downey's U.S. Pat. No. 5,522,635 teaches an apparatus for removably attaching a cover to a pick-up truck having a male stud which fastens to a channel-shaped plastic extrusion. The fastening elements each have a rigid snap portion with a trapezoidal-shaped terminal end that is fixed in spaced relationship to the cover. A lip is formed about each snap portion that engages flanges on the extrusion, and the snap portion is rectangular in shape.

U.S. Pat. No. 5,331,993 issued to Billbury is for a fastening device for securing a cover to a square boat frame. The device has a pair of resilient arms that extend outwardly from one side of the base wall member and include a gripping hook on the distal end for hooking around the radial edges of the boat rail.

U.S. Pat. No. 4,972,895 of Meshaka is for a drapery snap attachment to connect to a horizontal traverse track. Cooperating snap members attach to a carrier which is movable along the track in a fixed orientation facing pleated drapery. A T-shaped member is fixed to the base and is provided for each pleated portion of the drape.

U.S. Pat. No. 4,153,097, issued to Pettibone, discloses a skirting support system for mounting a skirt to an edge of an article of furniture having a slide with a male stud attached for securing the skirt. Fasteners are disposed at the outer surface of the clip face portion. A track is disposed in a slot in the furniture and the clips interface with the track. Skirting is coupled to the clips and the clips and fasteners are hidden from view by the upper portion of the track member.

Hess's U.S. Pat. No. 3,730,249 is for drapery installations having two panels slideably suspended from a support rod and adapted to be moved together or apart. When the panels are brought together, the intermediate fabric is collapsed and concealed between the flaps and portions of the panels.

DISCLOSURE OF THE INVENTION

In marine recreational vehicle, aircraft and trucking applications, drapes are used in cabins, sleepers and cabs of this type of vehicle. These drapes are usually heavy durable woven or plastic fabric and are attached with fasteners to metallic or thermoplastic track that is mounted directly to the interior structural wall of the boat or vehicle. Unlike residences and commercial buildings, this window covering must be securely attached as vibration and shock loading is constantly encountered. A channel-shaped track is ideal for this rugged application, as it securely holds fasteners within and is easily bent to fit the contour of the interior of the boat or vehicle. Normally track is installed with threaded fasteners penetrating the web of the track and slideable carriers or slides are disposed within the track itself. These carriers have, in the past, included a metallic stud for a snap fastener manufactured by Dot, Scoval, or the like. The snap fastener is well known in the art and has been in use for decades. The so-called snap action is obtained by the use of a spring locking ring placed inside a round socket and when forced upon a tapered stud, the spring expands and snaps over the stud holding it securely in place.

Since the stud is a separate element and requires attachment to the fastener, it is a primary object of the invention to mold the stud directly into the fitting, simplifying construction and eliminating the possibility of the stud coming loose from the fastener. While only the carrier or slide has been discussed, the track normally employs an end cap that covers each exposed end of the track. These caps are mounted to the interior surface with screws similar to those used to hold the track and serve the purpose of encapsulating the carriers in track, securing the ends and also to attach the drapes at each end. Again, prior art has used a metallic stud attached to the end cap where the instant invention now includes an integral molded-in stud configured in the same overall manner as the carrier.

A significant object of the invention is the inwardly tapered slope on the external surface of the stud. This angular slope is very important to the functioning of the invention as the metal studs that are in common use today have radial surfaces on the outside that coincide with the shape of the metal ring inside the female socket therefore the invention does not identically duplicate the shape of its metallic counterpart. The metal stud has a mushroom shaped rounded upper protruding rim that creates an inward radial curve contiguously receiving the socket spring. Through much experimentation and development it has been found that a slope of 5 degrees is optimum to not only hold the female socket in place but to continually urge it tightly upon the molded stud. Presently the metal female sockets have formed wire snap rings inside that vary in diameter to change the amount of pressure to release it from the stud. With the continual slope of 5 degrees the taper always pulls the socket into place regardless of the diameter of the internal snap ring, which is not the case with conventional studs making a noticeable improvement in its integrity while still permitting the desired release pressure. This novel feature saves expensive tooling and simplifies production methods in the injection molding process.

An important object of the invention is that the function is not altered in any way. By molding the male stud into the fitting the utility is not changed and the strength is not compromised, as the material has sufficient structural integrity to withstand installation and removal, particularly in the application where the drapes are changed only occasionally for cleaning and repeated manipulation is not the usual operational procedure.

While it does not appear on the surface to be a particularly labor intensive task to attach a metallic stud to a thermoplastic fitting with a pull type rivet or a threaded fastener, it must be remembered that three separate items must be purchased, inventoried and handled, as well as the necessary hand labor for such an installation. In production, any reduction in labor and material is greatly sought after, particularly when the function is not affected in any way.

Snap tape is also used in the industry in this application by attachment to carriers with the tape containing the male studs and the drapery employing the female sockets. The instant invention eliminates the need for such secondary elements, thus simplifying the installation considerably. It is now possible to attach the socket directly onto the drape or, if still desired, only a single piece of tape with the sockets attached may be secured onto the drape.

Another object of the invention is that the integral stud works equally well on easy, medium and hard action sockets. The stud has more than enough strength and rigidity to receive the various spring socket tensions that are available in today's industry.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 16:
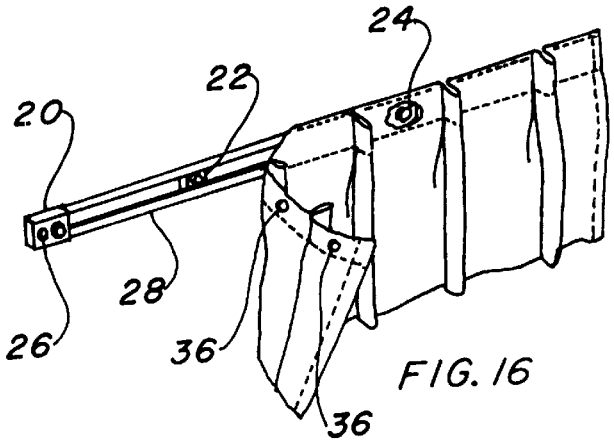
FIG. 16 is a partial isometric view of the track, fittings and drape attached together.

The best mode for carrying out the invention is presented in terms of a preferred embodiment with an end cap 20 and a carrier 22 configuration. The inventive concept of having a molded integral stud formed into a fitting is embodied in both configurations with the end cap illustrated in FIGS. 1 through 7, and the carrier in FIGS. 8 through 14, with FIG. 16 depicting both fittings as well as a track and drapes. While basically only specific fittings, i.e. an end cap 20 and a carrier or so called slide 22 are thoroughly discussed, the invention may be incorporated into any and all drapery fittings that use a snap fastener 24 for attachment purposes, including glides, end stops, etc.

The end cap 20, as shown in the figures mentioned above, is configured to fit on top of a track at each end and is secured in place with a flat countersunk head threaded fastener, such as a sheet metal or wood screw, however, self-tapping screws and even capscrews for threaded bores may be used with equal ease. A countersunk hole 26 is provided for this purpose, as illustrated, leaving the top of the end cap 20 unobstructed for attachment of the drapery.

Figure 1:
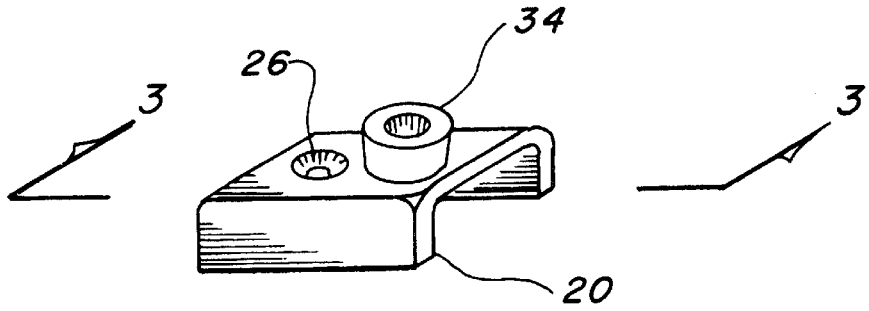
FIG. 1 is a partial isometric view of the preferred embodiment in the end cap configuration.
Figure 2:
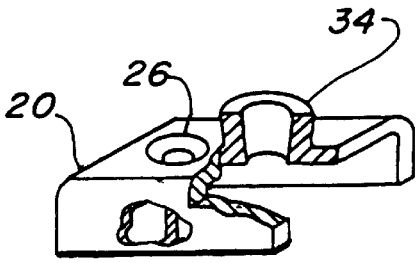
FIG. 2 is a partial isometric view of the end cap configuration fragmentarily cut-away to show the interior of the end cap.
Figure 3:
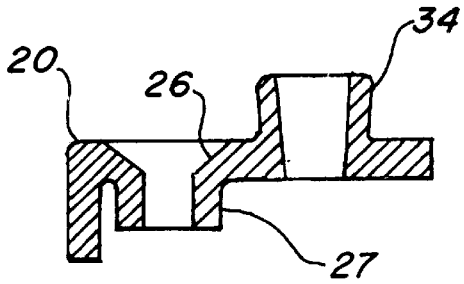
FIG. 3 is a cross-sectional view taken along lines 3—3 of FIG. 1.
Figure 4:
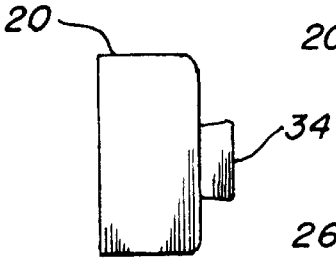
FIG. 4 is a left end view of the end cap configuration.
Figure 5:
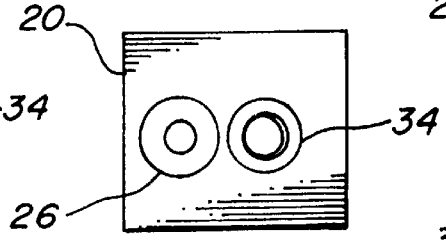
FIG. 5 is a top view of the end cap configuration
Figure 6:
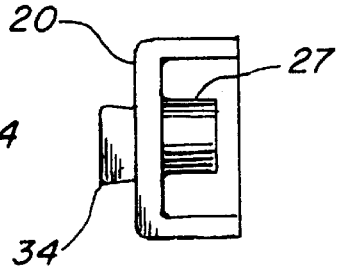
FIG. 6 is a right end view of the end cap configuration.
Figure 7:
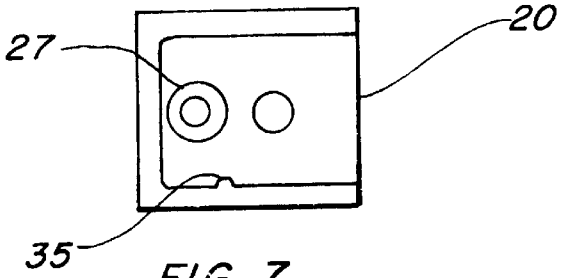
FIG. 7 is a is a bottom view of the end cap configuration.
Figure 8:
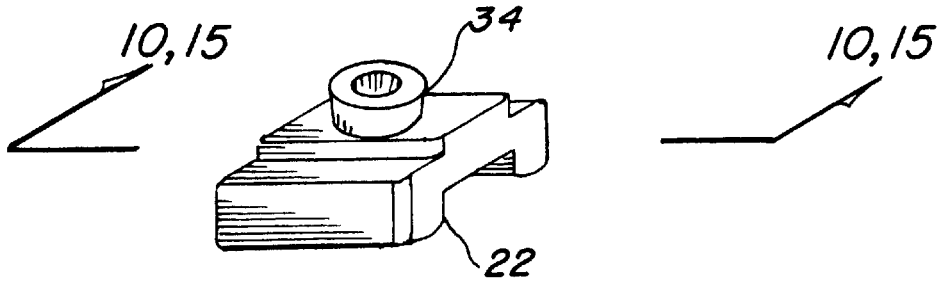
FIG. 8 is a partial isometric view of the preferred embodiment in the carrier configuration.
Figure 9:
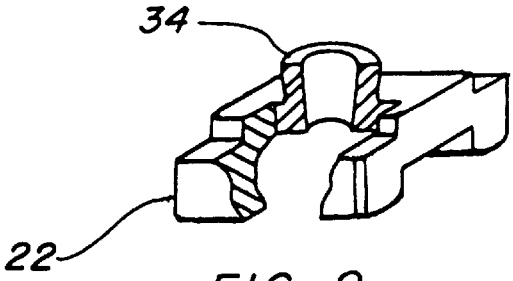
FIG. 9 is a partial isometric view of the carrier configuration fragmentarily cut-away to show the interior of the carrier.
Figure 10:
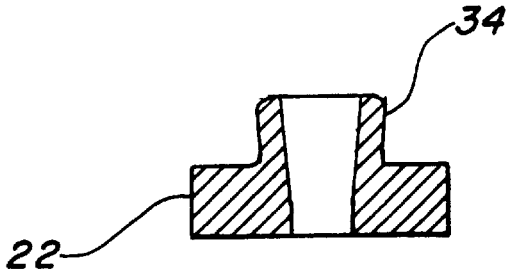
FIG. 10 is a cross-sectional view taken along lines 10—10 of FIG. 8.
Figure 11:
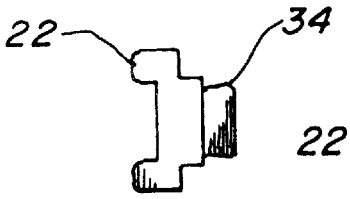
FIG. 11 is a left end view of the carrier configuration.
Figure 12:
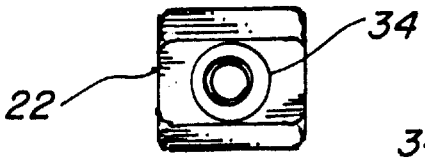
FIG. 12 is a top view of the carrier configuration
Figure 13:
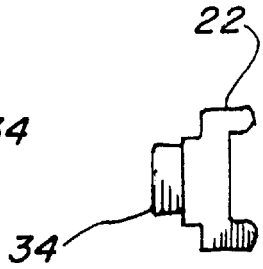
FIG. 13 is a right end view of the carrier configuration.
Figure 21:
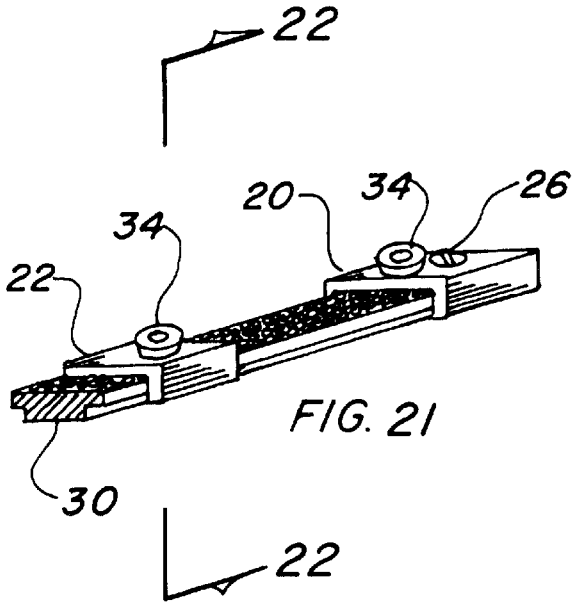
FIG. 21 is a partial isometric view of the track embodiment in the flat tee-shaped configuration with an end cap and carrier attached.
Figure 22:
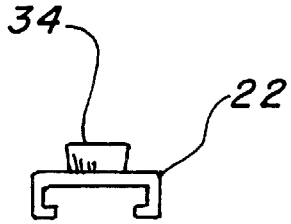
FIG. 22 is a cross-sectional view taken along lines 22—22 of FIG. 21.
Figure 23:
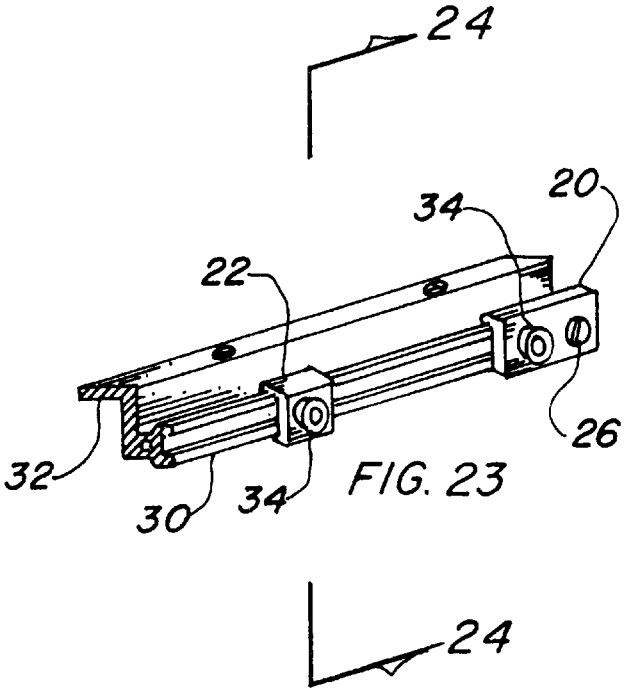
FIG. 23 is a partial isometric view of the track embodiment in the flanged tee-shaped configuration with an end cap and carrier attach
Figure 24:
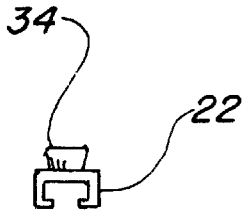
FIG. 24 is a cross-sectional view taken along lines 24—24 of FIG. 23.

The countersunk hole 26 is structurally reinforced with a sleeve 27 that protrudes downwardly around the hole 26 as shown in FIGS. 3 and 6. The end cap 20 completely covers both the top and end of the track, thus providing not only covering, but also encapsulates the carriers 22 that are positioned within the grooved track. It will be noted that while an extruded aluminum channel shaped track 28 is preferred, thermoplastic track fabricated in a similar manner, or even injection molded is also acceptable for use with the inventive fittings. Tracks may also be in a tee-shape 30, or have opposed outstanding legs with a narrower body spacing the legs from the attaching structure to permit the end cap 20 to fit over the end and the carriers 22 to slide over the top of the track, as illustrated in FIGS. 21 and 22. FIG. 23 and 24 further depict a tee-shaped track 30 that includes a mounting flange 32. Obviously, the fittings for the tee-shaped track 30 require different configurations of end caps and carriers, as illustrated in both FIGS. 21 and 23 also in cross-section in FIGS. 22 and 24. It should be further noted that the inventive concept remains unchanged, as the integral element that interfaces with the snap fastener socket 24 is completely identical. A raised boss 35 is positioned integrally within the vertical inside surface of the end cap 20 such that the end cap 20 is secured when slipped over a drapery track 28 permitting the attaching means, in the form of a screw to fasten the end cap 20 in place without passing through the drapery track 28. If the end cap 20 is urged forcibly toward the distal end of the drapery track the cap 20 will yield and deform sufficiently to permit the end cap 20 to slide over the boss 35 until the track 28 is completely encompassed and the screw may then penetrate the track itself if so desired.

The drapery fitting, also disclosed, is a carrier 22 that is configured to be contained completely within the drapery track 28 in the channel shaped configuration or over the extended legs of the tee-shaped track 30, illustrated in FIGS. 21 and 23. In either event, the carrier 22 is free to slide within the internal boundary confines of the track 28 or on top of the tee-shaped track 30, permitted by the structure of the carrier. This movable feature of the carrier is imperative, as drapes attached to these injection molded fittings must be slid open or closed in front of a window or opening in order to function appropriately.

Figure 14:
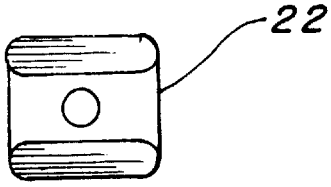
FIG. 14 is a is a bottom view of the carrier configuration.

The height and width of the carrier 22 is determined by the internal dimensions of the channel shaped track 28 and external dimensions for the tee-shaped track 30. In both cases, the carrier must be sized to slide freely along the entire length of the track even if it is bent to follow the shape of the surface to which it is attached. It will be noted that the carrier 22 is rounded or radial edges on the downward depending legs on each side, as shown in FIG. 14, to prevent the carrier from binding and make its movement smooth even if the track is bent to the shape of the inside of a truck cab or sleeper.

Figure 17:
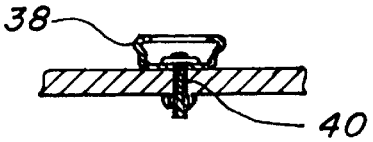
FIG. 17 PRIOR ART
FIG. 17 is an arbitrary cross-sectional view of the metallic snap fastener stud attached with a rivet, as commonly utilized in prior art.
Figure 18:
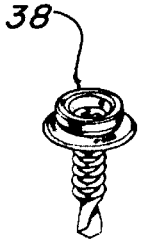
FIG. 18 PRIOR ART
FIG. 18 is an isometric view of a prior art metallic snap fastener stud in the self drilling configuration.
Figure 20:
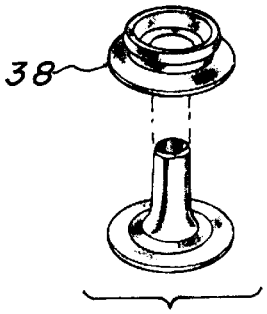
FIG. 20 PRIOR ART
FIG. 20 is an exploded isometric view of a prior art metallic snap fastener stud with an eyelet for attachment.
Figure 19:
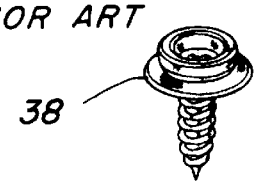
FIG. 19 PRIOR ART
FIG. 19 is an isometric view of a prior art metallic snap fastener stud in the self tapping configuration.

While end caps, carriers, slides, etc., by themselves, are old and well known in the art, the introduction of an integral male stud 34 is indeed novel and unique. This integral stud 34 is illustrated in all of the drawings and distends outwardly from the fitting and is configured to fit a snap fastener 24. In prior art it is well known that the fastener 24 includes two separate parts, a metallic socket 36 and mating metallic stud 38. FIG. 17 illustrates a metallic stud 38 attached to a fastener with a blind or conventional rivet 40, which is a normal procedure with fasteners of this type. FIGS. 18 through 20 depict other configurations of the metallic stud 38 with FIG. 18 showing the self drilling type, FIG. 19 the self tapping type and FIG. 20 the stud and eyelet configuration all of which are well known in the art. The integral stud 34 is configured much like the metallic type 38, except for the external sides that do not contain the reentering curve, such as illustrated in FIGS. 17 through 20. The integral stud 34 is molded into the fastener and is completely round and hollow with dimensions that are basically inversely proportional to the mating snap fastener socket 36 except for the inwardly tapered slope on the outside surface. The integral stud 34 is dimensionally compliant with the so-called industry standard "light duty," "medium duty" and "heavy duty" snap fastener, as the internal spring in the socket 36 is the determining factor denoting slight, medium and stout internal spring resilience respectively.

Figure 15:
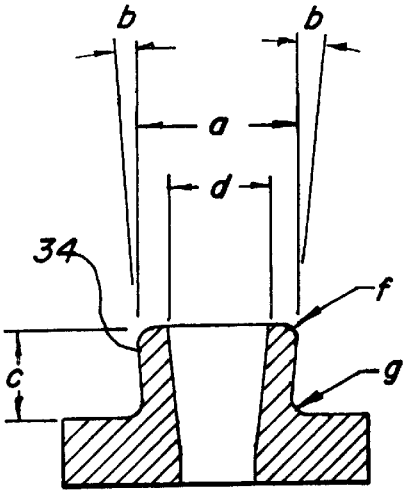
FIG. 15 is a cross-sectional view taken along lines 15—15 of FIG. 8 illustrating the dimensional limitations of the stud.

FIG. 15 illustrates the important dimensional limitations of the integral stud 34, including the shape which is completely round of an external diameter of from 0.396 to 0.403 inches (10.06 to 10.24 millimeters), with 0.400 inch (10.16 mm) preferred. The stud 34 has an inwardly tapered slope of from 4 to 6 degrees, with 5 degrees preferred. It has been found that with the above diameter and a height of from 0.155 to 0.161 inches (3.94 to 4.09 mm) and an external top and bottom radius from 0.02 to 0.04 inches (0.508 to 1.02 mm) is ideal with thermoplastic material. In order to provide the optimum elastic qualities of the material and permit molding without undue shrinkage, the integral male stud 34 is configured with a hollow cone having an internal diameter tapering from at least 0.250 to 0.213 inches (6.35 to 5.41 mm) from outside to inside, respectively.

In order to pictorially illustrate these dimensional limitations, FIG. 15 is presented with applicable designations as follows:

a) External diameter of the stud at its widest point.
b) Inwardly tapered slope on the external surface.
c) Overall height of the stud from the surface of the fitting.
d) Internal diameter at its upper large end.
e) Internal diameter at its lower small end.
f) External top radius at the top of the stud.
g) External bottom radius at the intersection of the stud and the fitting.

The drapery track integral stud fitting embodied as an end cap 20, carrier 22, or the like, is preferably made by the process of injection molding, which produces cost effective and dimensionally stable parts using a thermoplastic substance as its base material. Many types of plastic may be used, however, thermoset material is less desirable. Fabrication of the invention preferably employs materials such as polyester, polyamide, polypropylene, phenolic, polyphenylene sulfide, with acetyl having the most desirable characteristics. It should be noted, however, that other materials will function equally well with this invention.

Attachment means formed integrally with the fitting provided by its internal shape permit the end cap 20 to fit snugly over the track 28 or as shown in FIG. 16, 21 and 23. In the carrier configuration, attachment means are furnished by its physical shape, permitting it to slide freely within a channel shaped track 28, as illustrated in FIG. 16. If the carrier 22 is configured to be used with a tee-shaped track 30, as depicted in FIGS. 21 and 23, its external outline allows it to slide over the outside of the track while still being contained thereupon.

It may clearly be seen that in use the integral stud 34 is an ideal equivalent as it retains the same form, fit and function as the separate metallic snap fastener stud 38, illustrated by itself in FIGS. 17 through 20, and yet, is considerably more cost effective in both material and labor.

While the invention has been described in complete detail and pictorially shown in the accompanying drawings, it is not to be limited to such details, since many changes and modifications may be made in the invention without departing from the spirit and scope thereof Hence, it is described to cover any and all modifications and forms which may come within the language and scope of the appended claims.

What is claimed is:

1. An integrally molded stud fitting for hanging window covers on a drapery track comprising;

an injection molded drapery fitting having a front and a back, formed of thermoplastic material having dimensions compatible with both extruded aluminum and thermoplastic track, a hollow cylindrical shaped, integrally molded male stud extending outwardly from the fitting front, formed as an indivisible part of the fitting, said cylindrically shaped stud having an inside diameter on its hollow portion and an outside diameter with a peripheral inwardly tapered slope on the outside diameter configured such that a snap fastener socket disposed upon drapery material may be manually attaching or removed from the fitting, and means for attaching the fitting to a drapery track formed within the fitting such that the fitting may interface with drapery track in an operable manner.

2. The integrally molded stud fitting as recited in claim 1 wherein said drapery fitting is configured to define an end cap to cover an outside surface of a drapery track for terminating and attaching the track to a surface and to retain fittings within the track.

3. The integrally molded stud fitting as recited in claim 2 wherein said attaching means further comprises said drapery fitting end cap having a structurally reinforced countersunk hole through the fitting front for receiving a flat head countersunk screw.

4. The integrally molded stud fitting as recited in claim 2 further comprising, a raised boss positioned integrally within the bottom's surface such that the end cap is secured when slipped over a drapery track permitting the-means for attaching the fitting to a drapery track to fasten the end cap in place without passing through a drapery track or if urged forcibly toward a drapery track distal end the cap will yield and deform sufficiently to permit the end cap to slide over the boss until a track is completely encompassed.

5. The integrally molded stud fitting as recited in claim 1 wherein said drapery fitting is configured to define a carrier to be contained completely within a drapery track.

6. The integrally molded stud fitting as recited in claim 5 wherein said means for attaching the fitting to a drapery track further comprising said carrier configured with internal dimensions compliant with a drapery track permitting the carrier to slide freely within boundary confines of a drapery track.

7. The integrally molded stud fitting as recited in claim 1 wherein said drapery fitting integrally molded male stud further comprises a configuration that is compliant with a industry standard, light duty snap fastener socket which is known by its slight internal spring resistance, a medium duty snap fastener socket which is known by its intermediate internal spring resistance and a heavy duty snap fastener socket which is known by its stout internal spring resistance.

8. The integrally molded stud fitting as recited in claim 1 wherein said integral male stud inwardly tapered slope is tapered from 4 to 6 degrees at a right angle to the fitting front.

9. The integrally molded stud fitting as recited in claim I wherein said integral male stud is completely round having an external diameter of from 0.396 to 0.403 inches (10.06 to 10.24 mm).

10. The integrally molded stud fitting as recited in claim 1 wherein said integral male stud further comprises a height of from 0.155 to 0.161 inches (3.94 to 4.09 mm).

11. The integrally molded stud fitting as recited in claim 1 wherein said integral male stud inside diameter is defined as a hollow cone having an internal diameter tapering from at least 0.250 to 0.213 inch (6.35 to 5.41 mm) from, a largest diameter to a smallest diameter respectively.

12. The integrally molded stud fitting as recited in claim 1 wherein said fitting is thermoplastic.

13. The integrally molded stud fitting as recited in claim 12 wherein said thermoplastic fitting is acetyl.

* * * * *